United States Patent [19]

Zeng

[11] Patent Number: 4,763,506

[45] Date of Patent: Aug. 16, 1988

[54] AUTOMATIC TUBE BENDING MACHINE

[76] Inventor: Jun-Lang Zeng, No. 72-7, Jaw An Li, Pai Her Chen, Tainan Hsien, Taiwan

[21] Appl. No.: 25,725

[22] Filed: Mar. 13, 1987

[51] Int. Cl.[4] ..... B21D 7/04; B21D 43/02

[52] U.S. Cl. ..... 72/306; 72/384; 72/388; 72/420; 72/426

[58] Field of Search ..... 72/306, 321, 149, 154, 72/159, 384, 388, 420, 426

[56] References Cited

U.S. PATENT DOCUMENTS

| | | | |
|---|---|---|---|
| 2,565,717 | 8/1951 | Brogen | 72/306 |
| 2,964,085 | 12/1960 | Ghiringhelli | 72/306 |
| 3,128,817 | 4/1964 | Shaver | 72/426 |
| 3,175,386 | 3/1965 | Sproul | 72/384 |
| 3,245,433 | 4/1966 | Taylor, Jr. | 72/149 |
| 3,438,237 | 4/1969 | Sisler | 72/306 |

*Primary Examiner*—Daniel C. Crane

*Attorney, Agent, or Firm*—Browdy and Neimark

[57] ABSTRACT

An automatic tube bending machine, in which, an electric motor is adapted to drive a speed reduction multiple-pulley system which in turn powers a synchronous intermittent feeding device to feed tube pieces piece by piece into a moulding seat from a storage rack, the same pulley system also actuates a flywheel, and this flywheel drives a gear system that then spins a crank shaft having two symmetrical crank arms, which in turn move two face to face arranged splines, then this two splines drive their respective gears engaged therewith, and these gears in turn actuate two L-shaped outward bending moulds to rotate; at the other end of the same crank shaft, it is provided with a bevel gear; engaged with another bevel gear system so to drive another crank shaft, in such a manner, these two crank shafts rotate synchronously in opposite directions; in the meanwhile the latter crank shaft drives a sliding seat, on which is provided with an inward bending mould, located in the opposite side of the two L-shaped opposite outward bending moulds; when a piece of tube is fed to the moulding seat by the feeding device, it is bent into a definite shape by the relatively moved inward bending mould and the two outward bending moulds, located in the opposite side of this inward bending mould.

7 Claims, 2 Drawing Sheets

AUTOMATIC TUBE BENDING MACHINE

SUMMARY OF THE INVENTION

The present invention relates to an automatic tube bending machine, in which, an electric motor is utilized to drive a speed reduction pulley system which actuates simultaneously an intermittent movement feeding device, and two crank shafts rotating in opposite direction at synchronous speed. The feeding device feeds tube pieces to a moulding seat from the storage rack, and the relative movement between the inward bending mould and the two outward bending moulds, located in the opposite side of the inward bending mould, as they are driven by their respective crank shafts, bends automatically each tube piece into a definite shape.

Nowadays, almost all tube bendings are accomplished by punching, roll-pressing, and hydraulic-pressing measures, but all of these traditional measures have common operating shortcomings; since an operator is required to stand by the machine to feed tube pieces into the moulding seat, and after each tube piece is bent into the required shape, the operator has to remove it therefrom this mechanical repatative work not only waste manpower, but also often cause accidents, therefore, from economical and practical point of view, automatic operation is indispensably needed.

From this realization, the present inventor, based on past experiences, has devoted a long term, and efforts to set up a labor and time saving, automatic tube bending machine which has been proved efficient and reliable after a series of running tests.

One object of the present invention is to provide an automatic tube bending machine, of which mechanical steps are utilized to serve the continuous and automatic tube bending purposes without any human intervention.

The next object of the present invention is to provide an automatic tube bending machine, in which, an electric motor is utilized to drive a speed reduction pulley system which actuates a feeding device equipped with two symmetrical chains for effecting a synchronous movement, the two symmetrical chains are provided with a plurality of holding paws disposed at equal distance, and these paws move along with said chains so to pick up the tube, piece by piece, from the storage rack, and feeds it to the mould seat for bending into the required shape, this practical and economical automated material feeding means contributes to one of the special features of the present invention.

One further object of the present invention is to provide an automatic tube bending machine, the speed reduction pulley system, driven by a motor, actuates a flywheel, which in turn spins a rotating gear attached to a crank shaft that moves a pair of splines which drive a pair of L-shaped outward bending moulds by the engagement with a pair of gear and axle systems, in such a manner, a tube piece is bent into the required shaped by the reciprocating revolving movement of the L-shaped outward bending mould.

One more object of the present invention is to provide an automatic tube bending machine, in which, at the other end of the crank shaft, driving a pair of outward bending moulds, it is provided with a bevel gear, which transmits mechanical power synchronously to a crank shaft located in the rear side, and this crank shaft in turn drives a sliding device, on this sliding device, there is provided with an inward bending mould at proper locations with respect to the two outward bending moulds, in this manner, with a tube piece fed to the mould seat, the synchronized opposing repeating movement between the inward bending mould and two outward bending moulds bends the tube automatically and continuously into the required shape.

Still other object of the present invention, is to provide an automatic tube bending machine, in which, the outward bending moulds are provided with sliding seat devices, so that the clamping troughs on sliding seats clamp the tube piece during bending, in this manner, the amount of extension curvature at the outer edge of the tube during bending is smoothly compensated by the relative sliding movement of the sliding seats, so that breaking or damage to the tube piece during bending is avoided.

One more object of the present invention, is to provide a tube bending machine, wherein, the tube piece fed from the feeding device is clamped in the clamping troughs of the outward bending moulds by the pushing movement of inward bending mould sliding seat driven by the crank shaft; in order to prevent the inward bending mould sliding seat from being effected by the pulling action, generated in each return stroke of the continuously rotating crank shaft, when a tube piece is bended by the outward bending moulds, the crank shaft is provided with two corresponding fan-shaped pushing cam, thus, on the crank shaft pushing the inward bending mould sliding seat to a location in which the tube piece is clamped, the fan-shaped pushing cam take over and push firmly against said tube piece until the tube piece is bent into the required shape by the outward bending moulds and retreated from the inward bending mould sliding seat; in this way, the bending of a tube piece and the rejection of a bent tube are accomplished thereby.

Still another object of the present invention is to provide an automatic tube bending machine, in which, at the inward bending device pushing cams are provided on the sliding seat at locations opposite to the sliding seats of the outward bending moulds, also on the peripheral edges of these pushing cams, facing opposite to the clamping trough on outward bending mould sliding seats, it is also provided with semicircular concave shaped clamping troughs, said pushing cams are also in fan-shape, and sprockets are provided on their respective axles; and chains are used to connect this sprockets to other sprockets fixed to the machine frame, the outer side of this chains are fixed to the machine frame, in such a manner, when the inward bending mould sliding seat is pushed out by the crank shaft arm, the pushing cams will be pushed to rotate by the chains until the clamping trough on the same pushing cams comes out and pushes firmly against the tube piece, after the tube piece is bent or formed into the required shape, the inward bending mould sliding seat travels to it's return stroke, at this time the chain moves in the reverse direction to rotate the pushing cam until the peripheral edges of the pushing cams have no clamping trough face outwardly to break off the clamping action, and the mould ejection purpose is effected thereby, which also constitutes one of the special features of the present invention.

Further object of the present invention is to provide an automated tube bending machine, in which, the feeding device by providing a sprocket on another end of the crank shaft which drives the outward bending moulds, this sprocket being connected to another sprocket which is attached to a rotating disk having a poking rod via a chain to let the rotating disk to rotate synchronously with the crank shaft, the peripherial edge of the rotating disk is engaged to the concave-shaped peripherial edge of a driven disk having multiple concave-shaped peripheral edges and multiple equally spaced radial slots inbetween consecutive concave-shaped peripheral edged sectors, in this manner, the outer edge of the rotating disk slides on the concave-shaped outer edge of the driven disk, when the rotating disk completes one cycle rotation, i.e., the crank shaft drives the outward bending moulds and inward bending mould sliding seat to complete one bending cycle, the poking rod on rotating disk engages into one of the slots on tne driven disk to advance the driven disk to rotate one sector distance, at this time, the chain on the sprocket, attached to the same axle of the driven disk, drives the feeding device to advance a definite distance, i.e., a tube piece feeding distance, by this repetitive movement, during the period when a tube piece is bent into the required shape, another tube piece is ready to be fed in, therefore, the intermittent feeding purpose is served, this also constitutes one of the special features of the present invention.

Still further objective of the present invention, is to provide all automatic tube bending, in which, the bottom end at the tube storage rack is provide on a rotating axle with two fan-shaped cam located opposite to each other at a distance, the rotating axle is driven by the speed reduction pulley system via a chain, in this manner, these fan-shaped cams poke the tube pieces stored in the tube storage rack during the tube bending cycle to let each tube to be distributed and placed evenly, this also constitutes one of the special features of this invention.

Still further object of the present invention, is to provide a tube bending machine, in which, the same motor is utilized to drive multiple speed reduction pulley systems for synchronous movement of the feeding device, inward bending mould, and outward bending moulds, in this manner, the automated feeding, bending, and bent tube rejection purposes are served.

In order to better illustrate the present invention in detail, an embodiment example and drawings are given along with the specification as below, in which:

DETAILED DESCRIPTION

Figure 1:
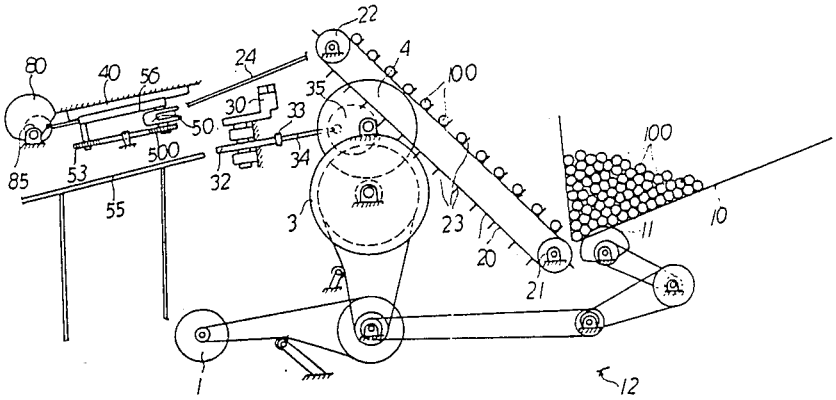
FIG. 1 is the side view of the automatic tube bending machine of the present invention.

Refer to FIG. 1, the present invention utilizes a motor 1 to drive multiple speed reduction pulley systems 12, and these pulley systems 12 at the same time drive two fan-shaped cams 11 on the same axle, and a flywheel 3. This flywheel 3 in turn drives two crank shafts 35 and 85, located in opposition to each other, to rotate in opposite direction, and these two crank shafts 35 and 85 further drive an inward bending mould and two outward bending moulds to produce opposite reciprocating movements, also at the same time, the feeding device feeds a tube piece 100 from the storage rack 10 into a proper location between the inward bending mould and the two outward bending moulds to be bent into the required shape.

In the present invention, the tube storage rack 10 is disposed at the front end of the machine frame, it is a hopper-shaped vessel with a tube outlet opening at its bottom end, also at the bottom end of the hopper-shaped vessel, there are provided a seat and right fan-shaped cam 11, in such manner that, when these cams 11 are driven to rotate by said electric motor 1 via the speed reduction pulley system 12, the peripheral edges of these two cams poke the tube pieces 100 stored in the tube storage rack to let the tube pieces to be distributed and placed evenly in the tube storage rack 10.

Figure 3:
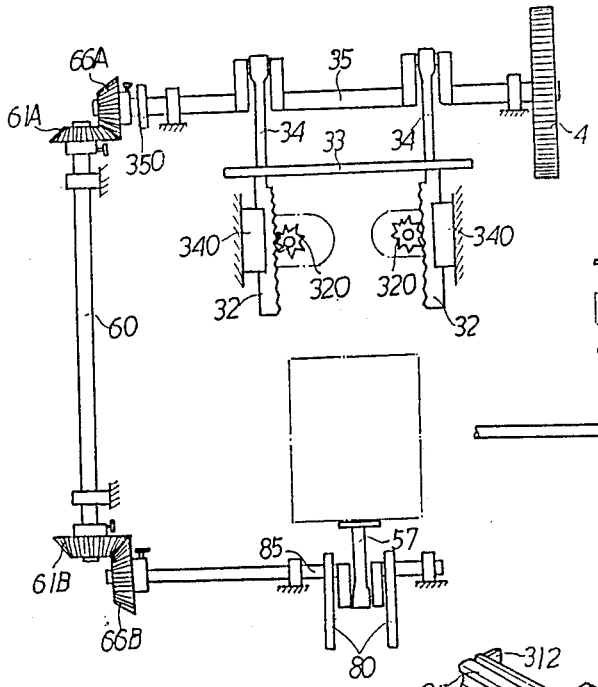
FIG. 3 is the operational illustration of the inward bending mould and outward bending moulds of the present automatic tube bending machine.

Said electric motor 1 also drives a flywheel 3 via the speed reduction pulley system 12, then, this flywheel 3 drives a rotating wheel 4 as shown in FIG. 3, this rotating wheel 3 in turn drives a crank shaft 35 having two separate crank arms, and the two crank arms drive their respective splines 32, guided by respective guiding seats 340, via their respective connecting rods 34 to move in the same direction, also at the joining points between connecting rods 34 and splines 32, they are fixed by a connecting board 33, then, these splines, moving in the same direction, are engaged with their respective driving gears 320 to drive the outward bending moulds (to be described later);

Furthermore, at the other end of this crank shaft, it is provided with a sprocket 350 and a bevel gear 66A, the bevel gear 66A is engaged with another bevel gear 61A which is mounted on one end of a driving axle 60, on the opposite end thereof, it is also provided with another bevel gear 61B which is then engaged with another bevel gear 66B, mounted on a crank shaft 85. In such manner crank shaft 85 drives the inward bending mould to move via a pushing rod 57 (to be described later), also at the two sides of the crank arm on crank shaft 85, they are provided with two symmetrical fan-shaped cam 80.

Figure 2:
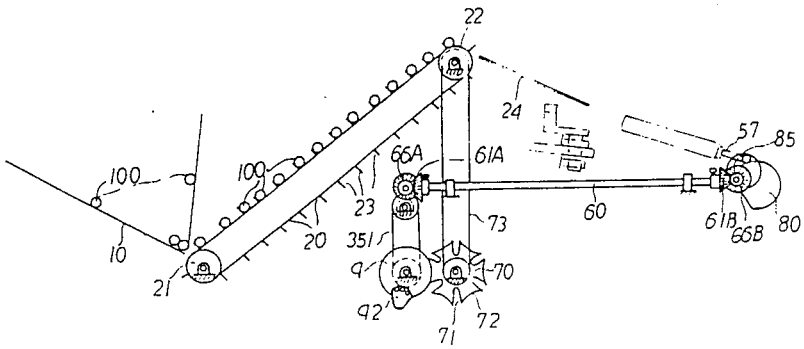
FIG. 2 is the side view of another side of the automatic tube bending machine of the present invention.
Figure 5:
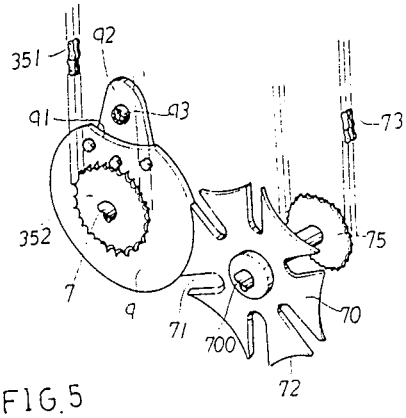
FIG. 5 is the perspective view of the intermittent feeding control device of the automatic tube bending machine of the present invention.

Refer to FIG. 2, the feeding device is symmetrical in both left and right side, also it moves synchronously, chain 20 is utilized to connect sprockets 21 and 22, sprocket 21 is located at the bottom end of the storage rack 10, and sprocket 22 is located at the top side of the outward bending device, therefore,the tube piece is moved from a low point to a high point by the inclined chain 20, further more, on both chains 20, left one or right one they are provided with multiple perpendicularlly-planted holding paws 23, these holding paws 23 are evenly distributed along each left and right chains 20, also these holding paws can go into the openings on bottom end of the storage rack 10 to pick up tubes, piece by piece, for delivery purpose.

Sprocket 350 on crank shaft 35, driven by said a rotating wheel 4, is utilized to drive another sprocket 352 via chain 351, on the same axle 7 of sprocket 352, it is provided with a rotating disk 9, and along the periphery of this rotating disk 9, it is provided with a concave-shaped sector 91, on the back side of the rotating disk 9 at the concave-shaped sector 91 it is attached with an elliptically shaped poking or protruded board 92 by two screws, also on the front side of the elliptically-shaped poking board 92, at a location corresponding to the periphery of said rotating disk 9, is provided with a poking rod having a ball bearing 93, the peripherial edge of the rotating disk 9 is engaged to driven disk 70, around the periphery of the driven disk 70 it is provided with multiple equally spaced radial slots 71, also around the periphery of the driven disk 70 at the sectors between two consecutive slots, they are provided with multiple concave-shaped edges 72, which can just relatively slidably move against the peripheral edge of the rotating disk 9; on the same axle 700 of the driven disk 70, it is provided with a sprocket 75 which is connected to said gear 22 by a chain 73.

Figure 4:
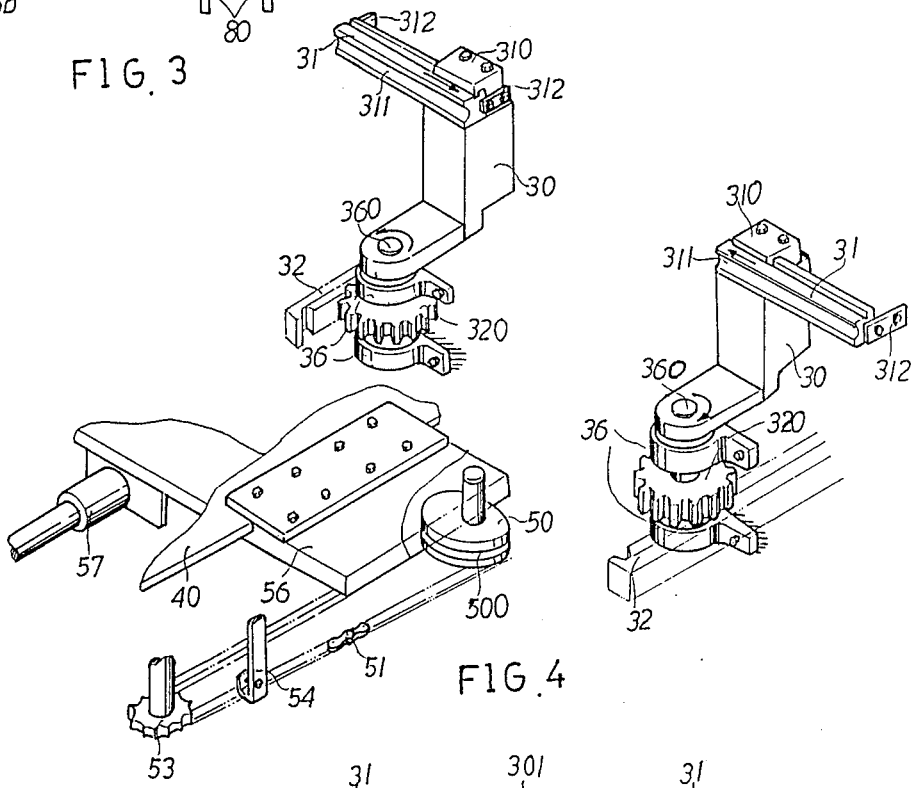
FIG. 4 is the perspective view for the inward bending mould and the outward bending moulds of the automatic tube bending machine of the present invention.

Refer to FIG. 4, the outward bending mould device is mounted on the machine frame, and bearing seats 36 are utilized to fix rotating axles 360, rotating axles 360 are provided with gears 320 as they engage to their respective splines 32 and driven by the crank shaft 35, on top ends of each rotating axle 360, they are provided with their respective L-shaped outward bending moulds 30. Furthermore, the two L-shaped outward bending moulds 30 rotate in opposite directions, when they are driven by their respective face to face arranged splines 32. Also at the top end of each L-shaped outward bending mould 30, it is provided with a fixing seat 310 having a guiding trough, and these fixing seats 310 are utilized to receive their respective sliding seats 31, also on both ends of the sliding seats, and they are provided with stop plates 312 to limit the travel stroke of the sliding seats 31 in the guiding trough of the fixing seats 310. Still further, on front surfaces of the sliding seats 31, they are provided with their respective claimping trough 311;

For the inward bending mould, two symmetrical sliding seats 56 and pushing cams 50 are provided at the two sides of an inclining fixed guiding seat 40, pushing cams 50 are ecentrically shaped, they are fixed on the sliding seat 56 by axle rods, on the peripherial edge of the protruded portion of this pushing cams 50, they are provided with respective semicircular clamping troughs 500, on top ends of axle rods, they are provided with their respective sprockets, on machine frame it is also provided with corresponding sprockets 53, chains 51 are utilized to connect respective two sprockets, the external sides of the chains 51 are held by a fixing clips 54, and these fixing clips are fixed on corresponding locations of the machine frame; crank 85 drives sliding seat 56 for reciprocating movement via a pushing rod 57, also it drives the two symmetrical cams 80 to push against the sliding seat 56 with their peripheral edges at the protruded portion, and two ball bearings are provided on the sliding seat 56 at locations on which the two cams 80 push against them for rotational push holding.

Therefore, when motor 1 rotates, the speed reduction pulley system 12 drives flywheel 3, and fan-shaped cams 11 to rotate, because the vibrating effect produced by the fan-shaped cams 11, the tube pieces 100 stored in storage rack 11 will become evenly distributed and placed; At the same time, flywheel 3 drives rotating wheel 4 via a gear, and the rotating wheel 4 in turn drives two face to face arranged splines 32 along guiding seats 340 for reciprocating movement, via the crank shaft 35, since gears 320 are engaged to their respective splines 32, therefore, this reciprocating movement is transmitted into the two L-shaped outward bending moulds 30 to rotate toward each outer sides, with axle rods 360 as their respective rotating center; at the same time, due to the synchronous driving of crank shaft 35, via bevel gears 66 and 61, the crank shaft 85 rotates in the reverse direction, as compared to crank shaft 35, to drive the sliding seat 56 along the guiding seat 40 for reciprocative movement, via the pushing rod 57, when the pushing rod 57 pushes the sliding seat 56 to its topmost location then comes back to it's returning stroke travel by the crank shaft 85, the two symmetrical fan-shaped cams 80 at two sides of the crank shaft 85 push against the two bearings on sliding seat 56 with their respective protruded peripherial edges until the sliding seat 56 reaches it's topmost location, since each fan-shaped cam 80 has a semicircular protruded portion, therefore, the sliding seat 56 stays in its topmost location until the non-protruded peripherial edges of the fan-shaped cams come again, then the sliding seat 56 is ready to be pushed to move forwardly again.

At the same time, crank shaft 35 drives rotating disk 9 to rotate synchronously, via sprocket 350, when crank shaft 35 rotates one revolution and the rotating disk 9 rotates synchronously also one revolution, at the same time an outward projecting ball bearing 93 engages in one of the slots 71 on driven disk 70, and drives it to advance one sector, this advancing movement is transmitted to sprocket 22 via sprocket 75 and chain 73 for driving two symmetrical chains 20 to advance one feeding distance, i.e. the time interval of a tube piece 100 to be fed into the bending moulds and bent into the required shape.

From above explanation, it is clear that the tube pieces 100 are fed intermittenly, one after another by the feeding device into the guiding rack 24, from this guiding rack 24, each tube piece 100 is fed to the front end of inward bending mould seat 56, and it is controlled by a positioning rack thereat, at this time, the inward, bending mould sliding seat 56 is located on it's bottommost position, therefore, when it is pushed to more upwardly along the guiding seat 40 by the pushing rod 57 to it's topmost position, the pushing cams 50 will be rotated to a corresponding angular position, since the outer side of chain 51 is fixed, at this angular position, clamping troughs 500 on protruded edges of pushing cams 50 are rotated to the front end of the inward bending mould sliding seat 56 for clamping the tube piece 100 at one side, on this time, the other side of tube piece 100 is also clamped by clamping troughs 311 on sliding seats 31 of outward bending moulds 30, then, the outward bending moulds 30 are driven to rotate toward their respective outer sides by crank shaft 35 via their respective splines 32, and the locus of rotation for each outward bending mould 30 is parallel to the peripheral edge of their respective pushing cams 50. From above explanation it can be seen that a tube piece 100 is clamped by the pushing cams 50 on inward bending mould seat and outward bending moulds 30, then it is bent by sliding seats 31 on top end of outward bending moulds 30, therefore, during bending, the amount of extention at the outer edge of a bent is compensated by the relative sliding movement of sliding seats 3l, and no stress breakage will be produced;

Since inward bending mould sliding seat 56 is driven to move by crank shaft 85 via pushing rod 57, when it reaches it's topmost position, the pushing rod 57 goes into it's return stroke travel, but at this time, the inward bending mould sliding seat 56 can still stay in it's topmost position, because two fan-shaped pushing cam plates 80 on two sides of crank shaft 85 take over at this moment, and pushes against the inward bending mould sliding seat 56 for keeping it stay in it's topmost position, at the same time, when outward bending moulds 30 has completed their tube piece 100 bending cycle and return to their original position, the fan-shaped pushing cam plates 80 are also rotated to their respective dented peripheral edge sides, and inward bending mould sliding seat 56 in turn slides down, and chain 51 becomes loose due to pushing cams 50 slide down with sliding seat 56, and cams 50 swing until their dented peripheral edges face front end of the sliding seat 56 by gravitational force, at this time no more clamping force exerts on bent tube piece by pushing cams 50, therefore bent tube piece falls down freely to the rejection guiding rack 55 and comes out therefrom; in this manner, through continuous running, the practical and economical advantages of the automated tube bending machine are therefore obtained.

Figure 6:
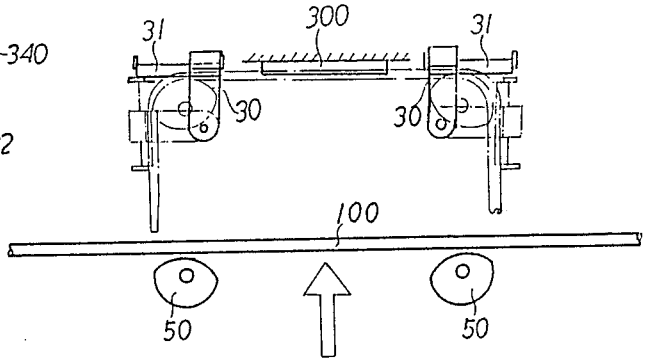
FIG. 6 is the tube piece bending movement illustration of the present automatic tube bending machine.

Furthermore, as shown in FIG. 6, in order to prevent a bent tube piece 100 from producing an arc-shaped stress deformation portion between two pushing cams 50, a positioning block 300 having a clamping trough is provide on the machine frame between the two outward bending moulds 30 to control the stress during bending.

Figure 7:
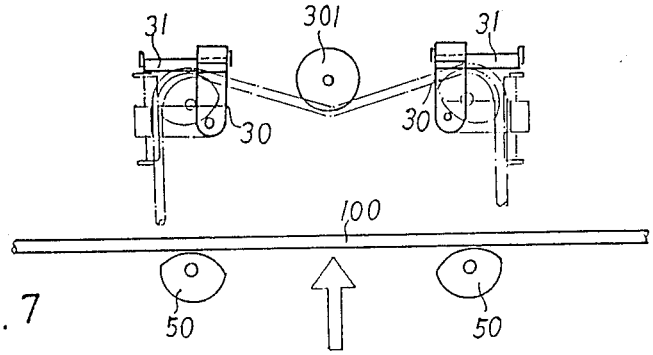
FIG. 7 is another tube piece bending movement illustration of the automatic tube bending machine of the present invention.

Also, as shown in FIG. 7, a forming wheel 301 having a clamping trough can be provided on the machine frame instead of the positioning block 300, in this manner, a tube piece 100 can be bent into an M-shaped tube piece due to the action of the positioning wheel 301.

I claim:

1. An automatic tube bending machine for bending tube pieces comprising;

a machine frame;

a tube storage rack having a hopper-shaped top opening and a material feeding bottom opening;

a pair of symmetrical fan-shaped cams located beneath said tube storage rack;

a feeding device provided at both sides of said tube storage rack, symmetrical on both sides, inclininglyy disposed, and feeding the tube pieces upwardly from said material feeding bottom opening;

an outward bending molding device located under a top end of said feeding device including two symmetrically located L-shaped outward bending molds, axle bearings for each of said bending molds fixed to said machine frame, axles in each said axle bearing rotatably secured to said respective axle bearing and securing said bending molds to said machine frame, a gear mounted on each of said axles, splines guided in respective guiding seats engaging with said gears, a first crank shaft having a rotating wheel at one end, and a sprocket, and a connecting gear means at an opposite end, a pushing rod connected to and driven by said crank shaft, a connecting board connecting said pushing rod to said splines to move them in their respective guiding seats with said splines in turn rotating their respectively engaged gear mounted on each of said axles;

an inward bending molding device located in a position opposite to said outward bending molding device including a fixed guiding seat, sliding seats provided on two sides of said fixed guiding seat, axle rods having a spocket and an eccentric pushing cam with a protruded peripheral edge on each said axle rod with said axle rods fixing said eccentric pushing cams to said sliding seats, said eccentric pushing cams having semicircular clamping troughs on their respective protruded peripheral edges, spockets fixed on said machine frame and having chains connecting said spockets fixed on said machine frame with said sprockets on said axle rods, fixing clips for fixing an outer side of said chain between said spockets, a second crank shaft having a connecting gear connected to said connecting gear means of said first crank shaft and symmetrical cam means on said second crank shaft to push said sliding seats;

a finished product rejection rack provided below said inward bending molding device and disposed at an inclination angle for gravitational rejection guiding;

a speed reduction system including a motor driving means and belt-connected pulley means, a flywheel connected to said belt-connected pulley means, said belt-connected pulley means connected to said pair of symmetrical fan-shaped cams located beneath said tube storage rack, said flywheel drivingly connected to said rotating wheel, an intermittent feeding device including a chain connected to said sprocket on said first crank shaft, a rotating disk connected to be driven by said chain of said intermittent feeding device, a driven disk intermittently advanced in rotation by said rotating disk, chain means connecting said driven disk to said feeding device, whereby said fan shaped cams are driven by said motor through said belt-connected pulley means, said flywheel drives said rotating wheel and said intermittent feeding device is driven so that said inward bending molding device, said outward bending molding device and said feeding device move synchroneously in such a manner that each tube piece is bent into the required shape, and the advantages of a continuous automatic tube bending are achieved thereby.

2. The automatic tube bending machine of claim 1 wherein said feeding device further includes a plurality of holding paws on a pair of symmetrical chains symmetrically disposed on both of said pair of chains along the periphery of said chains.

3. The automatic tube bending machine of claim 1 wherein said two symmetrically located L-shaped outward bending molds include top ends having respective sliding seats, and fixing seats with sliding troughs to limit the movement of said sliding seats, said sliding seats having opposite symmetry to each other in their connection to said fixed seats.

4. The automatic tube bending machine of claim 1 wherein ball bearings are provided on said sliding seats of said inward bending molding device corresponding with contact area on said sliding seats by said eccentric pushing cams on said second crank shaft supporting said sliding seats with sliding motion maintained between said eccentric pushing cams and said ball bearings.

5. The automatic tube bending machine of claim 1 wherein said intermittent feeding device further includes said rotating disk having a concave-shaped surface on its peripheral edge, said driven disk having multiple equally spaced radial slots and multiple concave-shaped edges around the periphery of said driven disk at sectors between consecutive ones of said slots, said concave-shaped edges engaging the peripheral edge of said rotating disk for sliding motion, a elliptical shaped protruding board extending from said rotating disk at said concave-shaped surface on its peripheral edge, an outwardly projecting ball bearing extending from the surface of said elliptical shaped protruding board over said concave-shaped surface on its peripheral edge positioned to engage said radial slots on said driven disk to advance said driven disk which advancing movement is transmitted to said feeding device by said chain means of said intermittent feeding device.

6. The automatic tube bending machine of claim 1 wherein a positioning block having a clamping trough is provided at said inward bending molding device in order to prevent a tube piece from being strained between said pushing cams on said inward bending molding device during a bending process.

7. The automatic tube bending machine of claim 1 wherein a positioning wheel having a clamping trough is provided on said machine frame between said two L-shaped outward bending molds so that a tube piece can be bent into an M shape by way of said positioning wheel.

* * * * *